United States Patent [19]

Gullett et al.

[11] Patent Number: 4,519,508

[45] Date of Patent: May 28, 1985

[54] SHELF STRUCTURE FOR A DISPLAY RACK

[75] Inventors: Edwin P. Gullett, Fayetteville; Gerald B. Davis, Clarkston; Rafael T. Bustos, Atlanta, all of Ga.

[73] Assignee: Leggett & Platt, Incorporated, Carthage, Mo.

[21] Appl. No.: 502,294

[22] Filed: Jun. 8, 1983

[51] Int. Cl.[3] ..... A47F 5/00

[52] U.S. Cl. ..... 211/59.2; 108/107; 108/137; 211/153; 211/175; 211/187

[58] Field of Search ..... 211/49 D, 187, 175, 211/134, 135, 153; 108/106, 107, 111, 137; 248/239, 244, 243

[56] References Cited

U.S. PATENT DOCUMENTS

| | | | |
|---|---|---|---|
| 2,443,871 | 6/1948 | Shield . | |
| 3,168,365 | 2/1965 | Evans | 211/153 X |
| 3,203,553 | 8/1965 | Pendergrast, Jr. . | |
| 3,279,618 | 10/1966 | Bergstedt . | |
| 3,341,027 | 9/1967 | Mackin et al. | 108/106 X |
| 3,389,882 | 6/1968 | Schlosser | 211/175 X |
| 3,900,112 | 8/1975 | Azzi et al. . | |
| 4,063,518 | 12/1977 | Bustos . | |
| 4,461,388 | 7/1984 | Bustos | 211/49 D |

FOREIGN PATENT DOCUMENTS

| | | | |
|---|---|---|---|
| 446299 | 1/1948 | Canada | 108/107 |
| 2114463 | 9/1972 | Fed. Rep. of Germany | 108/107 |
| 1445605 | 6/1966 | France | 108/137 |
| 313410 | 8/1969 | Sweden | 108/107 |

*Primary Examiner*—Robert W. Gibson, Jr.

*Attorney, Agent, or Firm*—Wood, Herron & Evans

[57] ABSTRACT

An improved shelf structure for use in a display rack having interconnected corner posts, comprising opposed, spaced shelf support arms connected by a plurality of telescoping cross members adapted to telescope between an extended and retracted position for varying the planar surface area of the shelf structure. An article support, carried by the cross members, includes top and bottom article engaging surfaces each having a different coefficient of friction and being adapted to contact articles placed on the shelf structure. Latch elements, releasably mounted to the shelf support arms, are adapted to mount the shelf structure to virtually all corner post designs of current display racks and to dispose the shelf structure in the desired angular attitude from front to rear.

19 Claims, 10 Drawing Figures

REAR
FRONT

SHELF STRUCTURE FOR A DISPLAY RACK

FIELD OF THE INVENTION

This invention relates to display racks, and more particularly, to an improved adjustable shelf structure adapted to mount to the corner posts of most types of display racks which are now commercially available.

BACKGROUND OF THE INVENTION

Display racks are commonly used in supermarkets and other stores to display items of merchandise which are generally sold as self-service items. A common example of the use of display racks is in the display and sale of cans or bottles of soft drinks in supermarkets, the bottles being removed by the customer from the display rack in a self-service manner.

Early designs of display racks comprised a plurality of planar horizontal shelves held in spaced relation by vertical corner posts, with items such as soft drink bottles being arranged in rows from the front to the rear of the shelf. Prospective customers remove the bottles at the front edge of the shelf and proceed to the rear of the shelf until it is empty. The main problem with this prior art shelf design is that it may be difficult for customers to reach bottles on the rear of the shelf, particularly if the shelves are of significant depth or if several shelves are closely spaced one above another. In addition, the merchandise toward the rear of the shelf may be hidden from customers as the shelf is emptied particularly if another shelf is disposed over it.

Merchandising techniques have become more sophisticated in recent years and the shelf structures of display racks have been redesigned in ways which display articles more attractively and provide easy access for customer removal. It has been found highly desirable to provide display racks with shelf structures which are adjustable both angularly and in planar fashion so as to vary the attitude and surface area provided to support self-service items. Angular adjustment of the shelf support may be made in several designs by tilting the front edge of the shelf above the rear edge. In many commercial situations, particularly the storage and display of chilled containers of soft drinks, milk and the like, it is desirable to dispose the rear edge of the shelf above its front edge so that the merchandise can be loaded onto the shelf from the rear and moves forwardly as articles are removed by customers from the front edge of the shelf. In this manner, merchandise is always located in the front portion of the shelf in full view of the customers. It has also been found desirable to provide shelf structures whose width may be expanded or retracted so as to vary the support or surface area provided for the display items. This enables the store to enlarge the surface area of the shelf supporting popular items which sell quickly and lessen the display area of low inventory items or items which do not sell quickly.

Gravity feed shelf assemblies, in which the rear edge of the shelf is adapted to be disposed above the front edge of the shelf, are known and disclosed for example in U.S. Pat. Nos. 3,203,553; 2,443,871; 3,279,618 and 3,900,112. One example of a shelf structure whose length is adjustable is found in U.S. Pat. No. 4,063,518. Although these shelf structures include one or more of the above named preferred features of modern display racks, each have several disadvantages. For example, all of these shelf structures are designed to attach to one type of corner posts or a fixed support. There are currently several designs of corner posts and supports for mounting shelf structures in position. Therefore once replacement shelf supports are needed, owners are forced to purchase either the same shelf supports used previously or new shelf supports and corner posts.

In addition, most shelf structures are provided with an article engaging surface having a coefficient of friction which cannot be varied. In some commercial situations it may be desirable for the article engaging surface to have a low coefficient of friction so that articles readily slide, such as in bottle supporting shelves in which the rear edge of the shelf is angled above the front edge. Other applications may require a higher coefficient of friction to resist article sliding. Existing shelf supports cannot accommodate both situations.

Therefore, it is an object of this invention to provide an adjustable shelf structure having mounting means which are adapted to mount the shelf support to virtually all currently available corner post designs or other fixed shelf supports of a display rack.

It is another object of this invention to provide a shelf structure having a removable aricle support formed with top and bottom article engaging surfaces having different coefficients of friction.

It is a further object of this invention to provide a shelf structure which is angularly adjustable to dispose either the front or rear edge above the other, and which is also adjustable in a planar fashion to vary the surface area of the shelf structure for supporting articles.

SUMMARY OF THE INVENTION

In accordance with these objectives, the display rack of this invention includes an improved shelf structure including a pair of opposed, spaced shelf support arms formed with an outwardly facing channel. Extending between and connecting the shelf support arms are a plurality of cross members adapted to telescope from an expanded to a retracted position so as to vary the article supporting surface area of the shelf structure. An article support is carried on the telescoping cross members and shelf support arms, which includes an upper and lower article engaging surface having different coefficients of friction. The article support may be disposed on the cross members and support arms with either surface facing upwardly or engage articles.

Latch elements are disposed at the four corners of the shelf structure and are movable withn the outwardly facing channels formed in the shelf support arms. The latch elements are formed with an offset hook element which is adapted to mount to virtually any corner post design currently utilized in display racks. In addition, the latch elements are adapted to dispose either the front or rear edge of the shelf structure above the other to obtain the desired attitude of the shelf structure.

DESCRIPTION OF THE DRAWINGS

The structure, operation and advantages of this invention will become further apparent upon consideration of the following discussion taken in conjunction with the accompanying drawings in which.

DETAILED DESCRIPTION OF THE INVENTION

Figures 1, 3, 4, 5A, 5B, 5C, 5D, 5E, 5F:
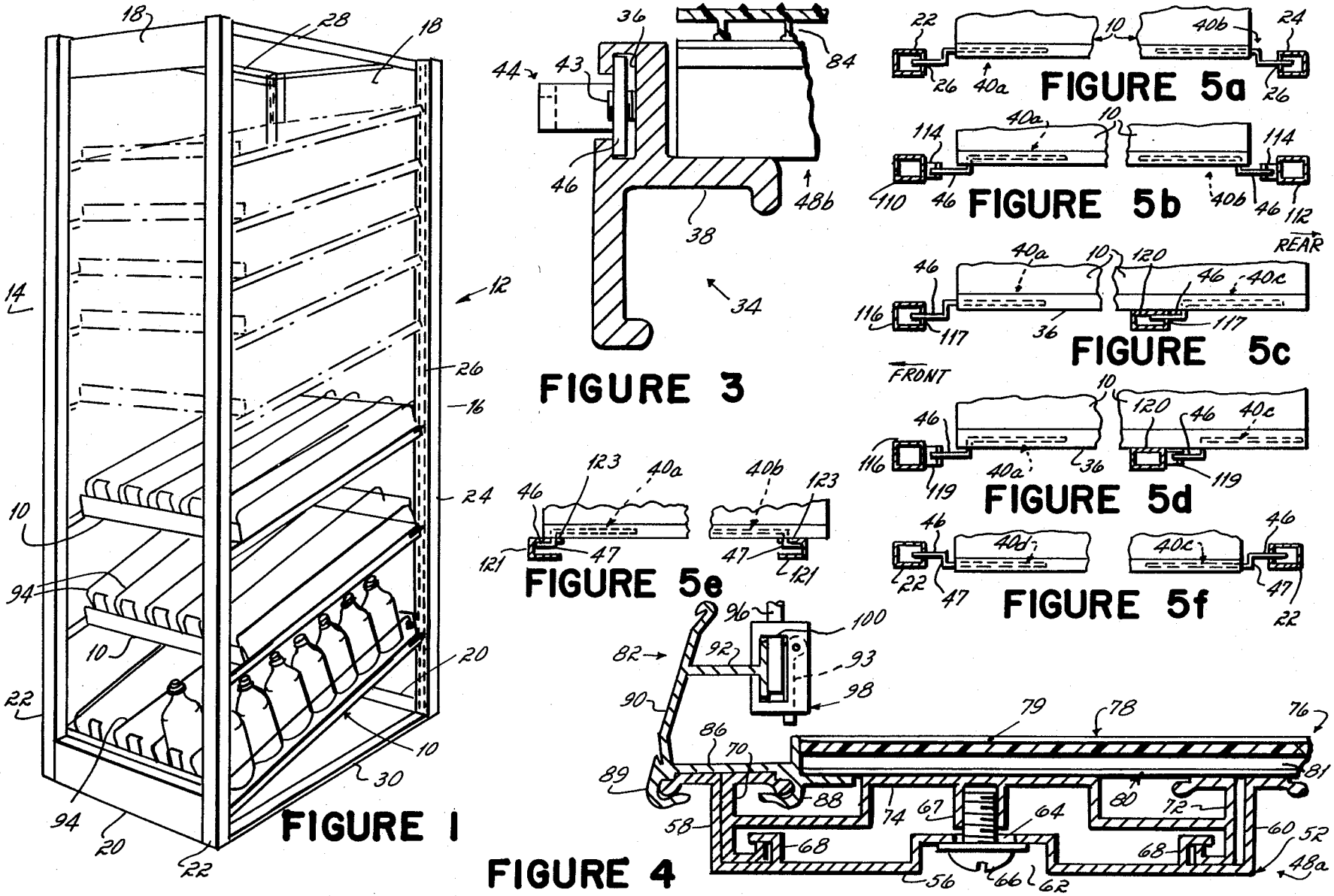
FIG. 1 is a perspective view of a display rack structured in accordance with the teachings of this invention.
FIG. 3 is a cross-sectional view taken generally along line 3—3 of FIG. 2.
FIG. 4 is a cross-sectional view taken generally along line 4—4 of FIG. 2.
FIG. 5*a* is a partial isometric view of the shelf mounting means herein adapted for engagement with one type of corner post.
FIG. 5*b* is a partial isometric view of the shelf mounting means herein adapted for engagement with a second type of corner post.
FIG. 5*c* is a partial isometric view of the shelf mounting means herein adapted for engagement with still another type of corner post.
FIG. 5*d* is a partial isometric view of the shelf mounting means herein adapted for engagement with still another type of corner post.
FIG. 5*e* is a partial isometric view of the shelf mounting means herein adapted for engagement with another type of corner post.
FIG. 5*f* is a partial isometric view of the shelf mounting means herein adapted for engagement in a different position to the corner post illustrated in FIG. 5*a*.

The shelf structure 10 of this invention is illustrated in combination with a display rack 12 as shown in FIG. 1. The display rack 12 consists essentially of opposed, stationary side frames 14 and 16, a plurality of shelf structures 10 extending between and spaced along the side frames 14, 16, and upper and lower headers 18 and 20 extending between the side frames 14, 16.

The side frames 14, 16 each consist of a front post 22 and a rear post 24. The front and rear posts 22, 24 of each side frame 14, 16 are formed with spaced vertical slots 26 along the length thereof which face inwardly toward the interior of the display rack 12 and are adapted to mount the shelf structures 10 as described in detail below. Each side frame 14, 16 also includes a head cross member 28 fixed at one end to the front post 22 and at the other end to the rear post 24, and a foot cross member 30 also fixed at its ends to the front and rear posts 22, 24.

The side frames 14, 16 are interconnected by upper headers 18 which extend between the front posts 22 and rear posts 24 of the side frames 14, 16, and a pair of lower headers 20 which connect to the front posts 22 and rear posts 24 of the side frames 14, 16 at their base. If desired, back panels (not shown) may be attached between the rear posts 24 to prevent customers from seeing beyond the rear of the display rack 12. Further details of the connections between corner posts 22, 24 which form the side frames 14, 16, and the interconnection of side frames 14, 16, do not form a part of this invention and are thus not described in detail herein. Reference should be made to U.S. Pat. No. 4,063,518 to Bustos, assigned to the same assignee as this invention, for a detailed description of such connections. The disclosure of the '518 patent is expressly incorporated by reference herein.

Figure 2:
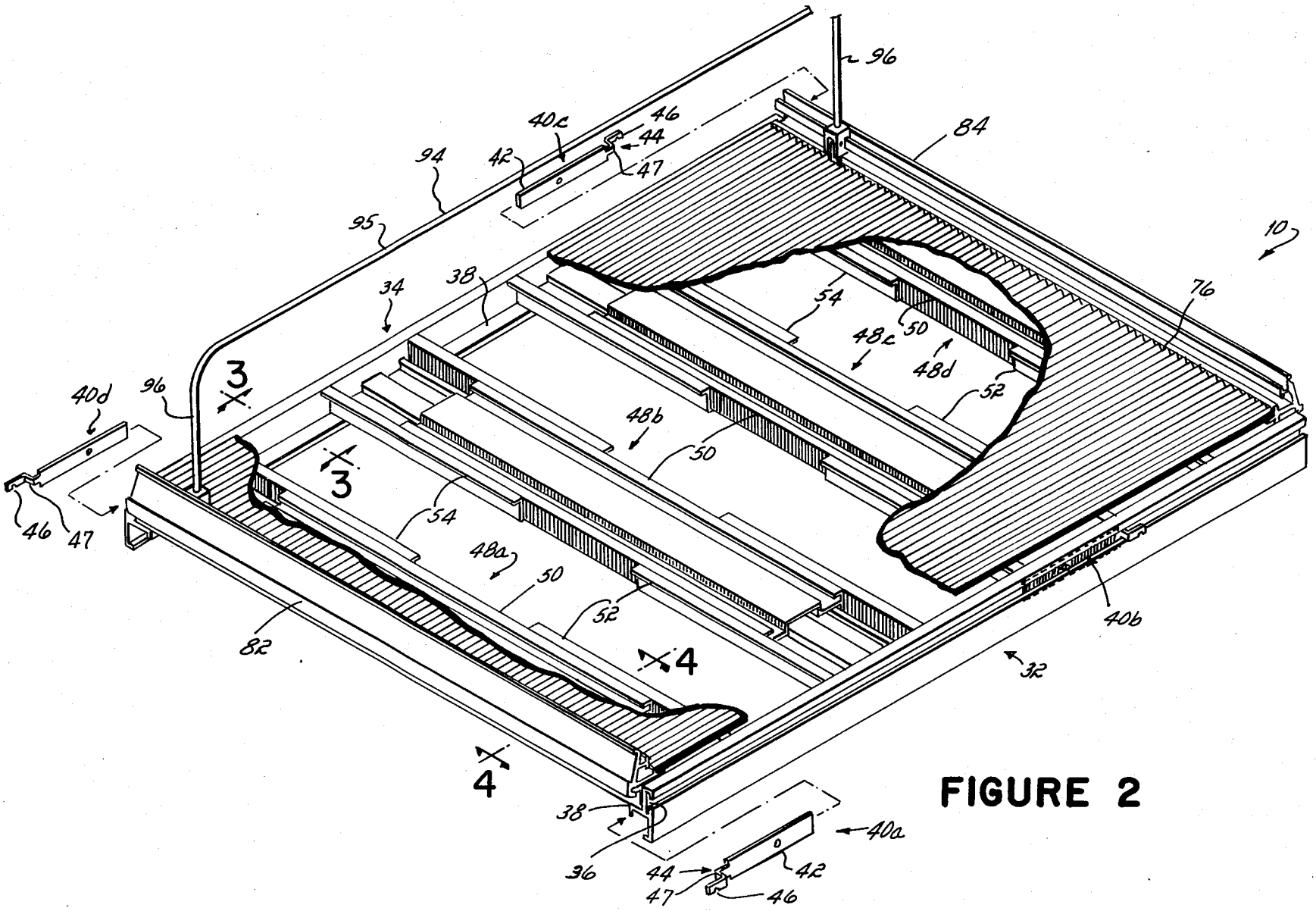
FIG. 2 is an isometric view of the support shelf herein with a portion of the article engaging surface cut away.

Referring now to FIGS. 2–4, the details of the shelf structure 10 of this invention are shown. The shelf structure 10 comprises a pair of opposed shelf support arms 32 and 34 which extend longitudinally from front to rear along the length of the shelf structure 10. Each shelf support arm 32, 34 is formed with an outwardly facing channel 36 and an inwardly extending shoulder or flange 38. Movable along the outwardly facing channels 36 are four latch elements 40*a–d*, disposed at each corner of the shelf structure 10. The latch elements 40*a–d* are Z-shaped including an elongate flat bar section 42 connected to an offset section 44 comprising an intermediate leg 47 and a hook 46. The intermediate leg 47 extends between and perpendicularly to the flat bar section 42 and hook 46, so as to dispose the flat bar section 42 and hook 46 parallel to one another. The flat bar section 42 is insertable within the channels 36 of shelf support arms 32, 34 and includes a screw 43 (See FIG. 3) extending therethrough which is adapted to engage the channels 36 to secure latch elements 40*a–d* in a desired position therealong. The hook 46 of offset section 44 is adapted to engage the vertical slots 26 of front and rear posts 22, 24, as well as other post configurations, for mounting shelf structure 10 thereto as discussed in more detail below.

Extending between and connecting to the opposed shelf support arms 32, 34 are four spaced cross members 48*a–d*. the use of four cross members 48*a–d* shown in the Figures is for purposes of illustration and it is contemplated that other numbers of cross members could be used in the shelf structure 10 of this invention. Each of the cross members 48*a–d* is formed in three sections including a common support 50 disposed between and slidably connected to a first telescoping section 52 and a second telescoping section 54. One end of the first telescoping section 52 is secured to shelf support arm 32 and one end of the second telescoping section 54 is secured to shelf support arm 34 by welding or any other suitable means.

As shown in FIG. 4, telescoping section 52 is formed generally in the shape of a tray with a base 56 and opposed side sections 58, 60 extending upwardly from the base 56. A recess 62 is formed midway along the base and includes a through bore 64 adapted to receive a screw 66. In addition, a pair of opposed L-shaped catches 68 extend upwardly from the base 56 of telescoping section 52. The cross section of telescoping section 54 (not shown) is identical to that of telescoping section 52.

The common support 50 is formed with a pair of E-shaped ends 70 and 72 mounted on opposite ends of a center section 74 from which a channel 67 downwardly depends. The screws 66 of telescoping sections 52, 54 extend within channel 67 and are adapted to tighten therewithin so as to secure the telescoping sections 52, 54 in place along the common support 50. The catches 68 of telescoping sections 52, 54 overlie a portion of the ends 70, 72 of common support 50 so as to permit relative sliding motion therebetween while maintaining telescoping sections 52, 54 in engagement with the common support 50. Therefore, to vary the width of shelf structure 10, the screws 66 of the telescoping sections 52, 54 are released from engagement with the channel 67 of common support 50 and the telescoping sections 52, 54 are then moved to the desired position between a fully extended or retracted position. The screws 66 are then tightened within channel 67 to secure the telescoping sections 52, 54 in place relative to the common support 50.

The cross members 48*a–d* and shelf support arms 32, 34 form a support for an article support 76 best shown in FIG. 4. The article support 76 is preferably formed of plastic or other suitable material which may be easily cleaned and which also may be cut to an appropriate size by hand tools to fully cover the adjusted width of the shelf structure 10. The article support 76 is formed with a first article engaging surface 78 on one side, and a second article engaging surface 80 on the opposite side. The first article engaging surface 78 is formed with a plurality of contiguous serrations or ridges 79, while the second article engaging surface 80 includes a plurality of spaced projections 81 having a rounded end.

The article support 76 may be placed on the cross members 48*a–d* so that either one of the engaging surfaces 78 or 80 faces upwardly to contact articles placed on the shelf structure 10. The first article engaging surface 78 provides a relatively high coefficient of friction and would be most suitable for use where limited sliding movement of articles placed on the shelf structure 10 is desired. A lower coefficient friction is provided by the second article engaging surface 80 which would be particularly useful, for example, in commercial applications where the shelf structure 10 tilts downwardly from the rear edge to the front edge so that articles placed thereon slide by gravity towards the front.

Articles placed on the shelf structure 10 are held from falling off by a front panel 82 and rear panel 84 preferably formed of a washable aluminum, resilient plastic or similar material. As shown in FIGS. 2 and 4, the front panel 82 includes a base 86 having opposed downwardly depending sockets 88 and 89 at either end, a side section 90 extending upwardly from the base 86 and an inwardly extending, T-shaped flange 92 connecting to the side section 90. The rear panel 84 has the identical configuration but is not shown in detail in the figures. The front panel 82 is first cut to length corresponding to the adjusted width of shelf structure 10, and its elongated socket 88 is then slid into engagement with the E-shaped end 70 of the common support 50 forming cross member 48*a*. The other elongated socket 89 of front panel 82 slid into engagement with the side section 58 of the telescoping sections 52, 54 which also form cross member 48*a*. The design of the front panel 82 allows it to readily engage and disengage from the cross member 48*a* as desired.

As shown in FIGS. 1 and 4, the article support 76 of shelf structure 10 may be divided into rows by a plurality of dividers 94, each formed with a horizontal section 95 disposed between vertical end sections 96. A number of over-center cam latches 98 are releasably mounted to the T-shaped flange 92 of front and rear panels 82, 84 by means of a cam lock 93 adapted to be tightened against the flange 92, and are slideable therealong. The cam lathces 98 are formed with an opening 100 adapted to receive a vertical end section 96 of the dividers 94. The cam latches 98 are slideable along the front and rear panels 82, 84 so that the location of dividers 94 and the space therebetween may be altered as desired. Alternately, other friction devices may be used to support the dividers along the front and rear panels 82, 84.

Among the primary advantages of the shelf structure 10 is that it may be mounted to virtually any type of corner post or fixed support configuration now used with currently available display racks. This is made possible by the unique offset design of the latch elements 40*a–d* which are disposed at the four corners of the shelf structure 10.

In the embodiment of the display rack 12 shown in FIG. 1, the front and rear posts 22, 24 of each side frame 14, 16 are formed with vertical slots 26 on their surfaces which face the interior of the display rack 12. With this configuration of the front and rear posts 22, 24, the flat bar sections 42 of latch elements of 40*a–d* are secured within the channel 36 of shelf support arms 32, 34 so that the offset sections 44 extend outwardly a short distance from the shelf structure 10 as shown in FIG. 5*a*. The hooks 46 of offset sections 44 are adapted to enter and seat within the vertical slots 26 of the posts 22, 24. If the shelf structure 10 is to be maintained in a horizontal attitiude, the front latch elements 40*a,b* and rear latch elements 40*c,d* are extended the required distance outwardly along shelf structure 10. Assuming it is desired to tilt the shelf structure 10 so that the rear edge is higher than the front edge, the rear latch elements 40*c,d* are extended an appropriate distance further along the shelf structure 10. This is accomplished by releasing the screws 43 which engage the channels 36 of shelf support arms 32, 34 and then tightening them when the latch elements 40*a,b* are extended to the appropriate position. The telescoping capability of latch elements 40*a–d* enables shelf structure 10 to be tilted at a variety of angular attitudes to assist different articles placed on the article support 76 in sliding from the rear to the front of shelf structure 10. For example, assuming paper milk cartons are to be stored on shelf structure 10, the rear latch elements 40*c,d* could be extended to tilt the shelf structure 10 at a relatively steep angle so as to allow the paper milk cartons to slide more readily to the front. The relatively steep angulation of shelf structure 10 could be accompanied by turning article support 76 so as to dispose the second article engaging surface 80 upwardly into contact with the milk cartons to further assist in sliding them along the shelf structure 10. It can be appreciated that a steep angulation of shelf structure 10 would be improper for aluminum soft drink cans, for example, because the cans could easily slide too quickly along shelf structure 10 when loaded from the rear and fall off. In displaying cans, the rear latch elements 40*c,d* could be retracted along the shelf support arms 32, 34 so as to lessen the angle at which the shelf structure 10 is tilted from rear to front. Additionally, the article support 76 could be inverted to dispose the first article engaging surface 78, having a higher coefficient of friction, into contact with the cans.

Other commonly used display racks include front and rear posts 110, 112 formed with spaced, upwardly extending hooks 114 as shown in FIG. 5*b*. In such display racks, the latch elements 40*a–d* are mounted to the shelf support arms 32, 34 in the same manner as described above in connection with the FIG. 5*a* embodiment. When mounting the shelf structure 10 to the FIG. 5*b* corner posts 110, 112, the hooks 46 of latch elements 40*a,c* seat within the corner posts hooks 114 as shown.

In the display rack designs of FIGS. 5*a* and 5*b*, the shelf engaging means associated with the front and rear posts, in the form of slots or hooks, are formed in the surfaces of the posts which face toward the interior of the display rack. However, in some applications it is desirable to form the slots or hooks on the outwardly facing surface of the rear posts and on the inwardly facing surface of the front post, so that the hooks or slots on both the front and rear posts are not visible to the customer.

To accommodate this display rack design, the latch elements 40*a–d* are mounted to the shelf support arms 32, 34 in the manner shown in FIGS. 5*c* and 5*d*. The front latch elements 40*a,b* are oriented so that their hooks 46 extend outwardly from the shelf structure 10 to engage the slots 117 (FIG. 5*c*) or hooks 119 (FIG. 5*d*) in the front corner post 116. This is accomplished by inverting the position of the rear latch elements 40*c,d* within the channels 36 of support arms 32, 34 so that their hooks 46 extend inwardly along the channels 36 of the support arms 32, 34. In this manner, the hook 46 of the rear latch elements 40*c,d* faces toward the front of shelf structure 10 so that it can engage the slots 117 or hooks 119 formed in rear surface of the rear posts 120 which faces outwardly from the interior of the display rack.

The latch elements 40*a–d* may also be used to mount the shelf structure 10 to a corner post 121, shown in FIG. 5*e*, in which slots 123 are formed along the sides of the corner posts 121. Latch elements 40*a–d* are mounted to shelf support arms 32, 34 in the same manner as shown in FIG. 5*a*, but the hook 46 extends through the slots 123 and intermediate leg 47 seats within the slots 123 to support shelf structure 10.

Referring now to FIG. 5*f*, a corner post 22 is shown formed with a plurality of spaced slots 26 as in FIG. 5*a*. However, in this illustration, the position of shelf structure 10 relative to the corner posts 22 is modified slightly by placing latch elements 40*a–d* on the opposite shelf support arm 32, 34. Latch elements 40*a,b* are thus moved to shelf support arm 34, and latch elements 40*c,d* are moved to shelf support arm 32. This allows the position of shelf structure 10 to be laterally adjusted to some degree relative to the corner posts 22 in applications where such adjustment is desired.

Therefore, using the latch elements 40*a–d* of this invention, the shelf structure 10 herein may be adapted to mount to virtually any commercially available display rack, allowing the shelf structure 10 to be sold as original equipment with display rack 12 or as a replacement for worn or damaged shelf structures adapted to be mounted to other display rack designs.

Various modifications, alternative constructions and equivalents may be employed without departing from the true spirit and scope of the invention, as exemplified in the foregoing description and defined in the following claims.

I claim:

1. A shelf structure for supporting articles in a display rack having corner posts, comprising:

opposed, spaced shelf support arms each formed with an outwardly facing channel;

cross members extending between said shelf support arms and connected thereto, said cross members being adapted to telescope between an extended and retracted position for varying the space between said shelf support arms;

an article support carried by said adjustable cross members and shelf support arms, said article support including a top surface and a bottom surface each having different coefficients of friction, said article support being adapted to be turned over so as to dispose either of said surfaces upwardly for contacting said articles; and latch elements movable within said outwardly facing channels of said shelf support arms, said latch elements being adapted to releasably connect to said corner posts for connecting said shelf structure to said display rack.

2. A shelf structure as in claim 1 in which said latch elements comprise two front latch elements disposed at the front corners of said shelf structure, and two rear latch elements disposed at the rear corners of said shelf structure, said front and rear latch elements each including a bar section movable along said outwardly facing channels of said shelf support arms and being adapted to releasably mount thereto, and an offset hook element adapted to connect to said corner posts of said display rack.

3. A shelf structure as in claim 1 wherein each said cross member comprises a first telescoping section fixed at one end to one of said shelf support arms, a second telescoping section fixed at one end to the other of said shelf support arms, and a common support, said first and second telescoping sections slidably engaging said common support and being adapted to slide apart relative to one another along said common support for extending said space between said shelf support arms and to slide together along said common support for retracting said space between said shelf support arms.

4. A shelf structure as in claim 3 further including means for releasably securing said first and second telescoping sections to said common support.

5. A shelf structure as in claim 1 in which said article support is formed with one surface having a plurality of spaced, parallel triangular-shaped elements having an outwardly extending edge for engaging an article.

6. A shelf structure as in claim 5 in which the other surface of said article support is formed with a plurality of spaced, parallel support elements having a rounded outwardly extending end for engaging an article, said support elements with said rounded end having a lower coefficient of friction than said triangular-shaped elements.

7. A shelf structure as in claim 1 further including a front panel and a rear panel and wherein one of said cross members is mounted at each end of said spaced shelf support arm, said cross members at each end of said shelf support arms being adapted to mount to said front and rear panels for retaining articles on said shelf structure.

8. A shelf structure as in claim 7 in which said front and back panels are each adapted to support spaced divider elements for separating articles disposed on said article support into rows, said front and back panels each being formed with a flange extending inwardly toward said shelf, said flanges supporting locking elements adapted to receive and secure said divider elements in position along said shelf structure.

9. A display rack having shelf structures for supporting articles comprising:

opposed, spaced side frames, each of said side frames including a front post and a rear post; said front and rear posts being formed with shelf engaging means for connection to said shelf structures;

side supports adapted to connect said front and rear posts of said side frames;

front supports extending between said front posts and rear supports extending between said rear posts for connecting said side frames together;

shelf structures each comprising:

opposed, spaced shelf support arms each formed with an outwardly facing channel;

cross members extending between said shelf support arms and connected thereto, said cross members being adapted to telescope between an extended and retracted position for varying the space between said shelf support arms;

an article support carried by said adjustable cross members and shelf support arms, said article support including a top surface and a bottom surface each having different coefficients of friction, said article support being adapted to be turned over so as to dispose either of said surfaces upwardly for contacting said articles; and latch elements movable within said outwardly facing channels of said shelf support arms, said latch elements being adapted to releasably connect to said shelf engaging means for connecting said shelf structure to said front and rear corner posts.

10. A display rack as in claim 9 in which said opposed front posts each include a front surface and a rear surface formed with said shelf engaging means, said opposed rear posts each include a front surface formed with said shelf engaging means and a rear surface, each said latch elements being formed with an offset hook element extending outwardly from said shelf support arms and being adapted to mount to said shelf engaging means of said front and rear posts.

11. A display rack as in claim 10 in which said shelf engaging means of said front and rear posts are slots.

12. A display rack as in claim 10 in which said shelf engaging means of said front and rear posts are hooks.

13. A display rack as in claim 9 wherein said opposed front posts each include a front surface and a rear surface formed with said shelf engaging means, said opposed rear posts each include a front surface, and a rear surface formed with said shelf engaging means, each said latch elements being formed with an offset hook element extending outwardly from said shelf support arms and being adapted to mount to said shelf engaging means of said front and rear posts.

14. A display rack as in claim 13 wherein said shelf engaging means formed along said front and rear posts are slots.

15. A display rack as in claim 13 wherein said shelf engaging means formed along said front and rear posts are hooks.

16. A shelf structure for supporting articles in a display rack having corner posts, comprising:

opposed, spaced shelf support arms each formed with an outwardly facing channel;

cross members extending between said shelf support arms and connected thereto;

an article support carried by said cross members and shelf support arms; and latch elements movable within said outwardly facing channels of said shelf support arms at each corner of said shelf structure and being formed with means for mounting said shelf structure to said display rack, said latch elements being adapted to telescope between a retracted and extended position so as to mount said shelf support to said display rack at different angular attitudes.

17. A shelf structure as in claim 16 in which said latch elements comprise two front latch elements disposed at the front corners of said shelf structure, and two rear latch elements disposed at the rear corners of said shelf structure, said front and rear latch elements each including a bar section movable along said outwardly facing channels of said shelf support arm including means for releasably mounting said latch elements to said shelf support arms.

18. A shelf structure as in claim 17 in which said means for releasably mounting said latch elements to said shelf support arms is a screw extending through a threaded bore formed in said bar section of said latch elements, said screw being adapted to engage said channels of said shelf support arms to secure said latch elements therealong.

19. A shelf structure for supporting articles in a display rack having corner posts, comprising:

opposed, spaced shelf support arms each formed with an outwardly facing channel;

cross members extending between said shelf support arms and connected thereto, said cross members being adapted to telescope between an extended and retracted position for varying the space between said shelf support arms;

an article support carried by said adjustable cross members and shelf support arms; and latch elements movable within said outwardly facing channels of said shelf support arms at each corner of said shelf structure and being formed with means for mounting said shelf structure to said display rack, said latch elements being adapted to telescope between a retracted and extended position so as to mount said shelf support to said display rack at different angular attitudes.

* * * * *